United States Patent [19]

Gartner et al.

[11] Patent Number: 4,967,577

[45] Date of Patent: Nov. 6, 1990

[54] ELECTRONIC LOCK WITH MANUAL COMBINATION OVERRIDE

[75] Inventors: Klaus W. Gartner, Palos Verdes Estates; Alan K. Uyeda, Rosemead, both of Calif.

[73] Assignee: La Gard, Inc., Torrance, Calif.

[21] Appl. No.: 437,312

[22] Filed: Nov. 17, 1989

Related U.S. Application Data

[63] Continuation of Ser. No. 205,384, Jun. 10, 1988, abandoned.

[51] Int. Cl.[5] ..... E05B 47/00

[52] U.S. Cl. ..... 70/279; 70/303 A; 70/333 R

[58] Field of Search ..... 70/277–279, 70/303 A, 303 R, 333 R

[56] References Cited

U.S. PATENT DOCUMENTS

| | | | |
|---|---|---|---|
| 2,053,901 | 9/1936 | Findlay | 70/303 A |
| 2,660,873 | 12/1953 | Bennett et al. | 70/303 A |
| 2,722,820 | 11/1955 | Coffey | 70/303 X |
| 3,045,466 | 7/1962 | Herlong | 70/303 A |
| 3,176,486 | 4/1965 | Richardson | 70/333 R X |
| 3,702,070 | 11/1972 | Gartner | 70/278 |
| 3,968,667 | 7/1976 | Gartner et al. | 70/303 A |
| 3,981,167 | 9/1976 | Phillips | 70/311 |
| 3,991,596 | 11/1976 | Gartner | 70/303 A |
| 4,257,249 | 3/1981 | Johns-Hunt | 70/303 A |
| 4,328,689 | 5/1982 | Keller et al. | 70/303 A |
| 4,420,955 | 12/1983 | Marold | 70/303 A |
| 4,628,715 | 12/1986 | Uyeda et al. | 70/333 R |
| 4,745,784 | 5/1988 | Gartner | 70/277 |
| 4,756,176 | 7/1988 | Uyeda | 70/303 A |
| 4,831,851 | 5/1989 | Larson | 70/303 A |

*Primary Examiner*—Robert L. Wolfe
*Assistant Examiner*—Suzanne L. Dino
*Attorney, Agent, or Firm*—Poms, Smith, Lande & Rose

[57] ABSTRACT

An electronic lock with manual combination override for opening of a lock by both an electronic and manual means. The electronic lock has a bolt operating release mechanism which operates to allow opening of the lock by either the electronic or manual mode. The electronic and manual modes both operably open the lock through operation of the bolt operating release mechanism. The bolt operating release mechanism is a multi-component assembly operable as a unit or relative to each component dependent on the mode of operation. The electronic mode is operably by use of electronic components which include but are not limited to, pressure-sensitive switches, logic circuit, and a circuit mounting board. An electronic combination is generated, retained and operable with the electronic components to open the lock.

20 Claims, 4 Drawing Sheets

IV
VIII
IX
28
27
29
80
36
34
37
38
30
35
33
22
20
90
120
124
121
123
122
125
126
70
75
102
60
65
100
101
103
41
150
42
16
50
56
22

ELECTRONIC LOCK WITH MANUAL COMBINATION OVERRIDE

This is a continuation of copending application Ser. No. 07/205,384 filed on June 10, 1988, and now abandoned.

BACKGROUND OF THE INVENTION

This invention relates in general to an electronic lock for use as a means for securing goods and areas requiring a high degree of security. The introduction of electronics into the lock field has seen many improvements. The use of sophisticated electronic logic circuitry has enabled the implementations of a series of complex and unique electronic combinations which has made tampering for improper entry into secured areas more difficult. While electronic locks do provide for improved security, they do present a number of unique problems.

Electrical surges in the power line supplying power to the electronic lock can damage the circuitry making impossible the opening of the lock by the proper operator. The resultant cost to have the safe or secured area opened could be significant in light of the materials used for the enclosure and the difficulty in gaining entry by cutting through those materials. In addition, misfunction could also result from tampering, or loss of power making opening of the lock impossible.

One of the objects, therefore of the current invention is to disclose and provide for an electronic lock which can be opened, despite an electronic catastrophe. Specifically, one object is to have the electronic lock have a manual combination override which enables opening of the electronic lock by a strictly mechanical mechanism. A further object of the present invention is to disclose and provide for a common mechanism for opening the lock operable by either a electronic mode or a manual combination override feature. Such a mechanism would enable the electronic lock of the present invention to minimize space and components, as well as have it utilized for applications where either electronic or manual locks are now utilized to secure goods or an area. Still, another object of the present invention is to disclose and provide for a conversion kit to convert current electronic locks and manual combination locks over to the multifunction electronic lock with manual combination override.

The manual combination override would incorporate tumblers and gates in a design similar to that found in U.S. Pat. No., 3,981,167. An object of the inventions using such a design is to provide for a mechanical means for opening an electronic lock.

Of course, it is an object of the current invention to provide for a reliable lock with the sophistication of state of the art electronics with a manual override feature to ensure the ability of opening the lock 100% of the time, independent of environmental conditions. The present invention meets the previously stated objects and it also meets other objects, that, although not specifically listed as objects, are evident from the description herein.

SUMMARY OF THE INVENTION

The improvement of an electronic lock by means of the current invention will enable the manual opening of the lock through a manual combination override provision. The electronic lock incorporating the current invention includes a dial operated plurality of tumbler wheels having gates to receive a fence member of a bolt operating release mechanism when the manual combination is dialed, an electronic means for generating a lock opening signal when a second combination is entered into said electronic means. The improvement comprises a bolt operating release mechanism.

The bolt operating release mechanism has three components assembled as one unit which interacts with the dial and tumblers above, and a dial operated cam. The bolt operating lever has a nose portion at one end that meshes with the cam and an opposite end pivotally attached to a lock bolt. There is a separate fence incorporated into a fence-spindle assembly mounted on the bolt operating lever. A control plate is transversely mounted to the fence and matingly mounted to the bolt operating lever.

The fence-spindle assembly, bolt operating lever, and the control plate move as a unit when the lock is opened when the manual override provision is utilized. The bolt operating lever is released from the unitary movement with the control plate and said fence when the lock is opened using the electronic mode.

The electronic mode comprises a series of pressure-sensitive switches which, when contacted by a push pin on the cam of the dial operated cam, causes an electrical contact. Subsequent and repetitive manipulations of the dial operated cam with axial displacement will generate a electronic signal to release the holding means, which holds the control plate in position with the bolt operating lever. The holding means for example could be a solenoid, but it is not limited to such.

The input of the electronic combination as noted above, will have the bolt operating lever move to mesh with the cam disc. Upon subsequent rotation of the dial operated cam, the lock will open.

DETAILED DESCRIPTION OF PREFERRED EXEMPLARY EMBODIMENT

Figure 1:
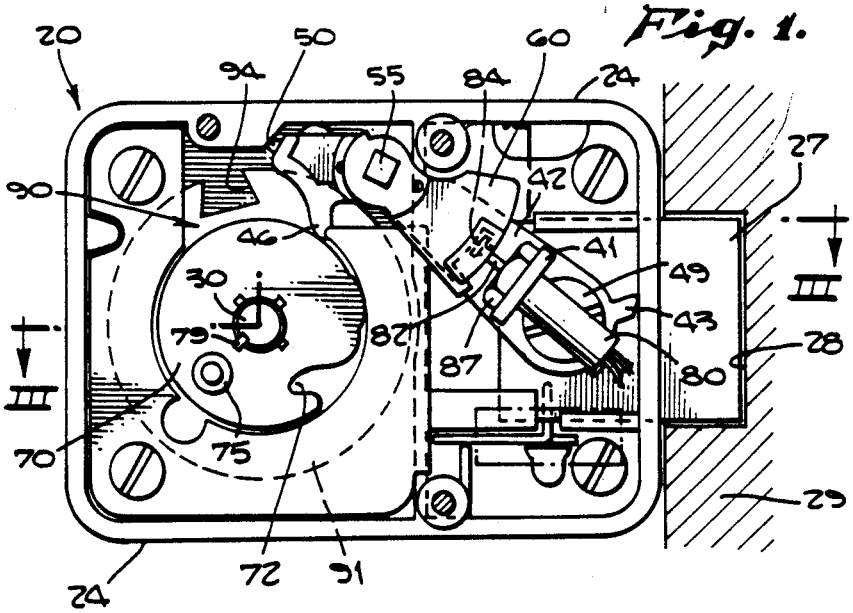
FIG. 1 is a plan view of a preferred exemplary embodiment of the electronic lock with manual combination override in accordance with the current invention.
Figure 3:
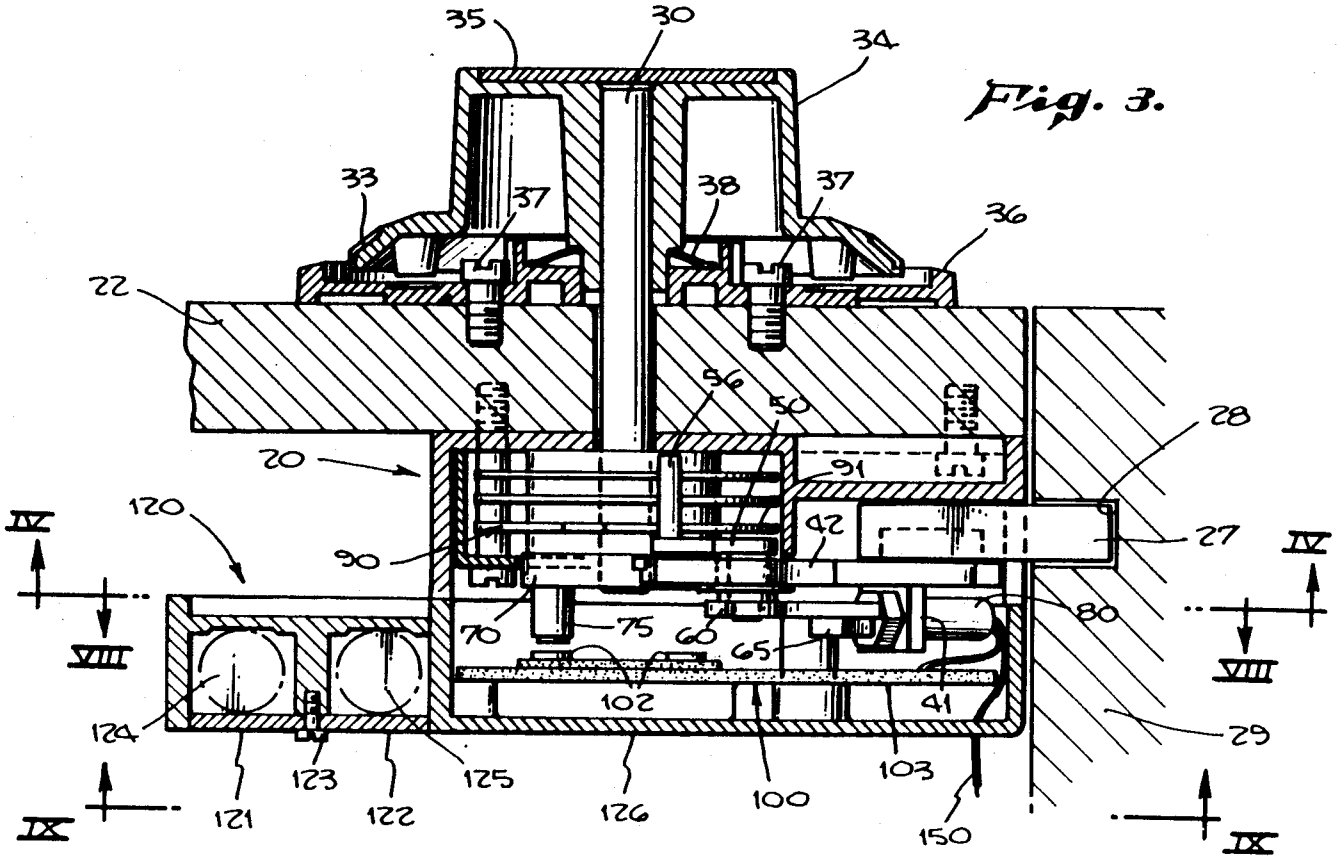
FIG. 3 is a sectional view taken through plane III—III of FIG. 1.

Referring now to FIG. 1, the preferred exemplary embodiment of an electronic lock with a manual combination override, according to the present invention, mounted to a wall 22 (as shown in FIG. 3) which is representative of the door of a safe or security room, or portions of a wall adjacent to such doors with the dial and dial associated mechanism on a forward side of a wall. Therein is the tumbler means, latch, release lever and associated actuated means, as known in the art, located on an opposite interior side of the wall from the dial within a housing 24, as much more fully explained hereinafter. Housing 24 of lock 20 also contains an electronic means for generating electronic signal that will open lock 20 by throwing bolt 27 from recess 28 of wall 29. The invention as shown in FIG. 1 shows a tumbler 91, a gate of tumbler 94, a means for enabling a nose portion 46 to mesh with a cam opening 72 of cam 70 which will allow the lock to be opened by those formulas in the art for manual tumbler operable combination locks.

Figure 2:
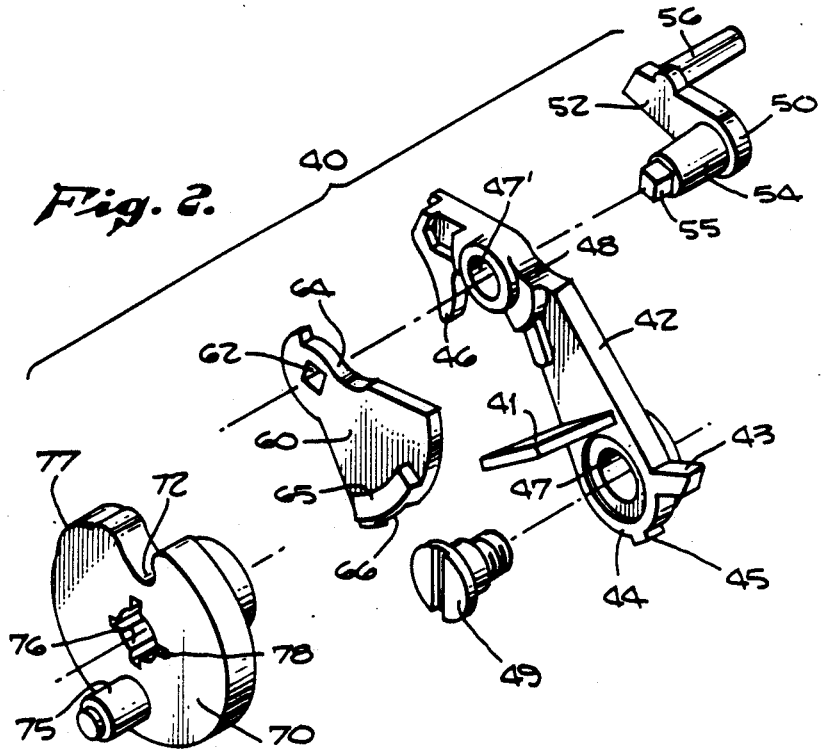
FIG. 2 is an exploded view of the bolt operating release mechanism and cam disc of FIG. 1.

Bolt operating release mechanism 40, as shown in FIG. 2, is incorporated into the lock housing as shown in FIG. 1. It is through the operation of the bolt operating release mechanism 40 which enables the lock to be opened by an electronic means as well as a manual combination tumbler gate arrangement. Bolt operating release mechanism 40, as shown in FIG. 2, will be discussed in more detail hereinafter.

FIG. 3 shows the lock 20 attached to the inside of a wall or door 22. The dial 34 is attached to shaft 30, its length is from the dial through wall 22 into the area of the bolt operating release mechanism 40 where the shaft 30 connects with a cam disc 70. The manipulation of the dial 34, shaft 30, and bolt operating mechanism 40 enables the operation of the lock in a traditional manual mode, utilizing tumblers as indicated by 90, or by an electronic means as indicated by electronic means 100. The shaft 30 is biased outward by a biasing means shown as a spring disc 38. Shaft 30 can move axially into lock 30 by overcoming bias spring 38, enabling push pin 75 to contact the electronic means 100. Push pin 75 rotates through the axial motion of shaft 30 by means of cam disc 70 (shown more clearly in FIG. 1).

Electronic means 100 can be powered by an exterior power source as indicated by power cord 150 or by means of a battery power means 122 which can be either a dry or wet cell, as shown in FIG. 3.

Dial 34 mounts to a dial disc ring 36 which attaches to wall 22 by means of bolt 37. A faceplate 35 is mounted to the front of dial 34. Dial 34 has along its edges divisions and markings 33 for rotational positioning of said shaft 30 in order to operate the lock 20 in the electronic or manual mode.

Figure 4:
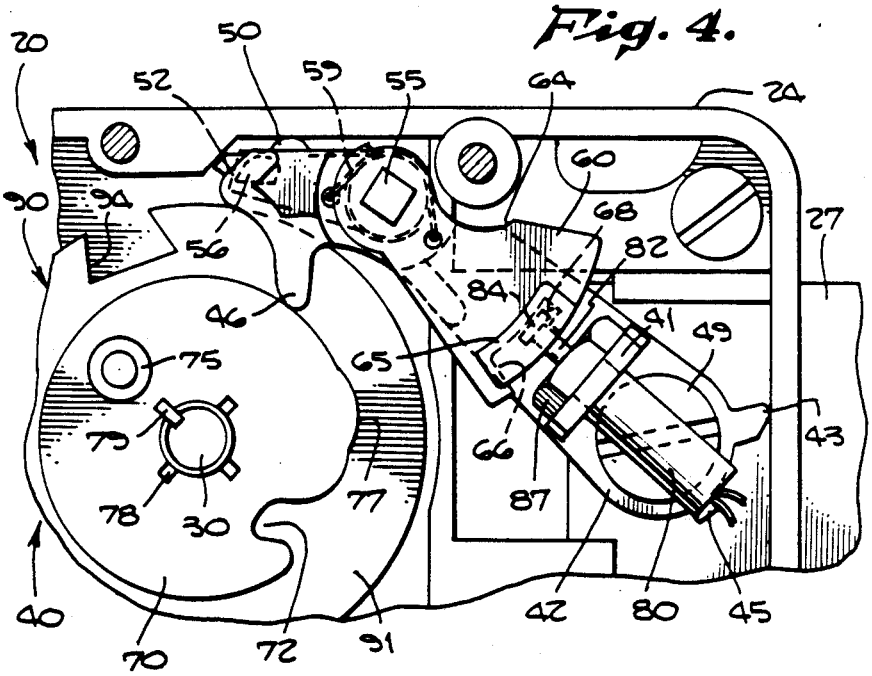
FIG. 4 is an exploded and partially in section view of the electronic bolt with manual combination override of FIG. 1.
Figure 5:
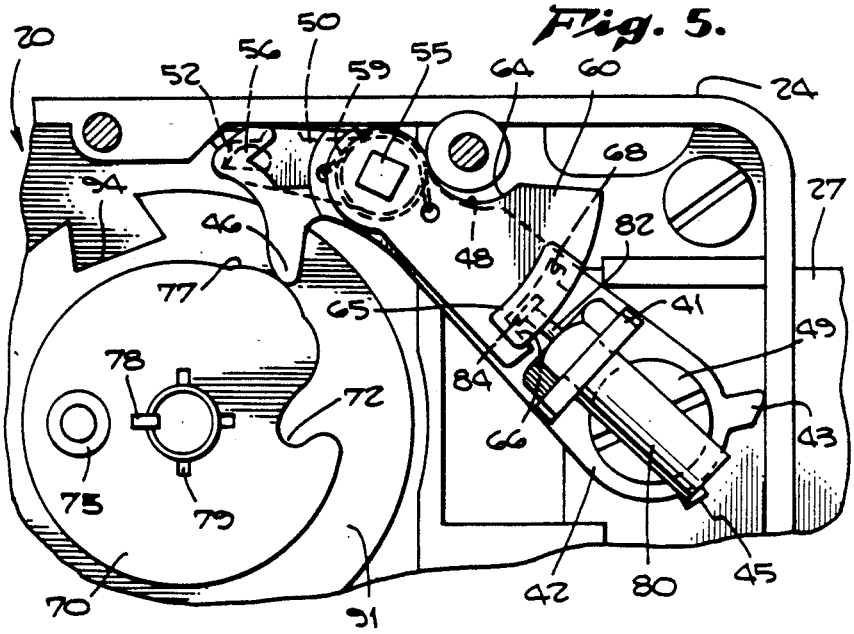
FIG. 5 is an exploded and partially in section view of the exemplar of FIG. 1 rotationally adjusted thereto.

FIG. 4 shows a rearward cutout view into the housing 24 of lock 20 inside wall of a secured area or door of a safe. Cam 70 is rotated by dial 34 through its connection by shaft 30. FIG. 4 shows push pin 75 which contacts electronic means 100 (not shown, but see FIG. 3). As dial 34 and shaft 30 are rotated, the nose portion 46 of the bolt operating release mechanism 40 rides along the circumference of cam disc 70. The bolt operating release mechanism 40 is a multi-component assembly as indicated in FIG. 2, including components 50, and 42, 60. During non-operation, the bolt operating release mechanism 40 maintains a configuration as shown in FIG. 4 with the assistance of a solenoid holding means 80. During input of the combination into electronic means 100 and the proper rotation of dial 34 and shaft 30, nose portion 46 is contacted positionally by a raised portion 77 of cam disc 70 as shown in FIG. 5. Raised portion 77 positions a control plate 60 of the bolt operating release mechanism 40 for withdrawal of a solenoid armature 82 and its tab head 84 from control plate 60.

Figure 6:
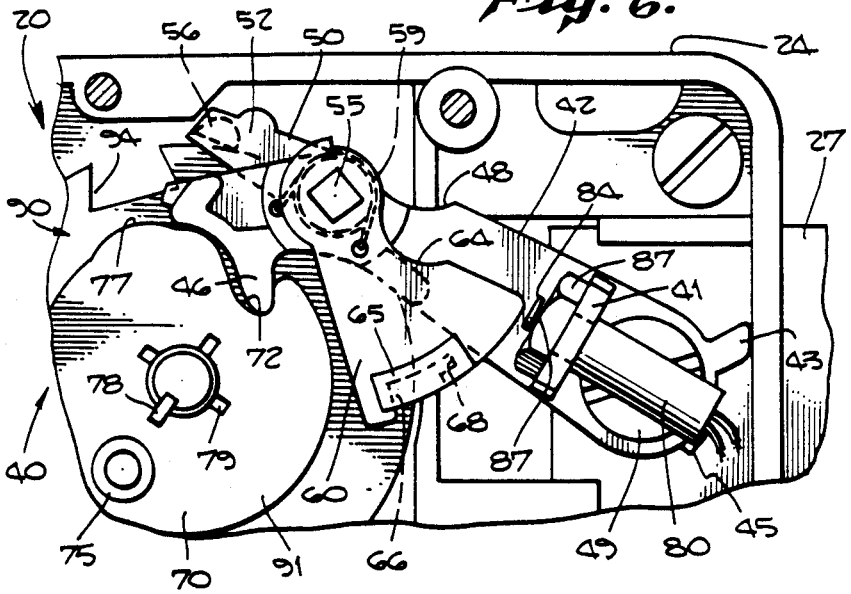
FIG. 6 is an exploded and partially in section view of the exemplar of FIG. 1 subsequent to the generation of an opening electronic signal by the electronic means thereof.

FIG. 6 illustrates the nose portion 46 of the bolt operating release mechanism 40 engaging cutout 72. Upon generation of an electronic signal which causes the withdrawing of said solenoid armature 82 and head tab 84, which enables said nose portion 46 to engage the cam disc 70, whereupon further rotation of dial 34 and shaft 30, bolt 27 will withdraw from its recess 28 in wall 29 opening lock 20.

The lock 20 can be opened by use of the manual mode in the instance where the electronic combination is lost or there is a loss of power to the electronic means 100 or a misfunction thereof. The operation of the manual mode is done with tumblers and gates in a manner known in the art for the manual operation of a combination lock.

Figure 7:
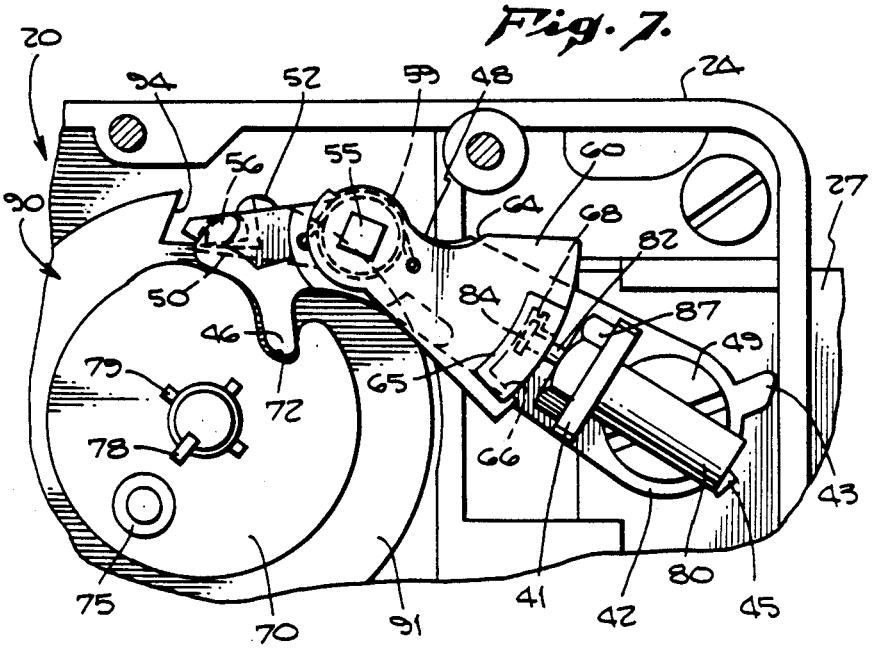
FIG. 7 is an exploded and partially in section view of the exemplar of FIG. 1 subsequent to the operation of the manual override feature thereof.

FIG. 7 shows the manipulation of shaft 30 and tumblers 90 so that a fence member 56 can enter gate opening area 94 to engage the gates and allow nose portion 46 to engage cam disc cutout 72. The tumbler 91 represents a plurality of parallel tumblers 90. After the fence member 56 engages gate opening area 94, subsequent rotation of the dial 34 will have lock bolt 27 withdraw from its recess 28 within wall 29.

Figure 8:
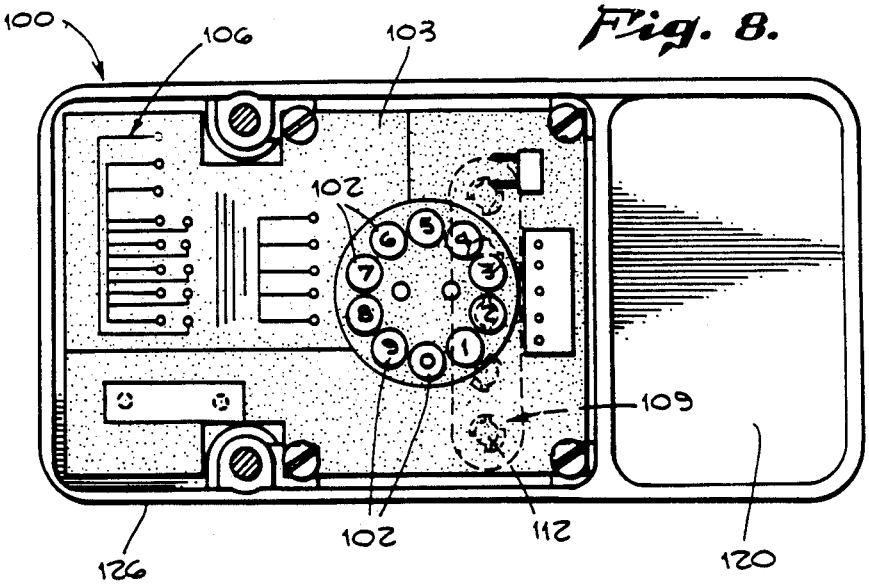
FIG. 8 is a plan view of the electronic means of the exemplar of FIG. 1 in accordance with the invention for generation of an opening electronic signal.
Figure 10:
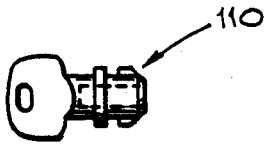
FIG. 10 is a plan view of the combination adjustment key for the electronic means of the exemplar herein.
Figure 9:
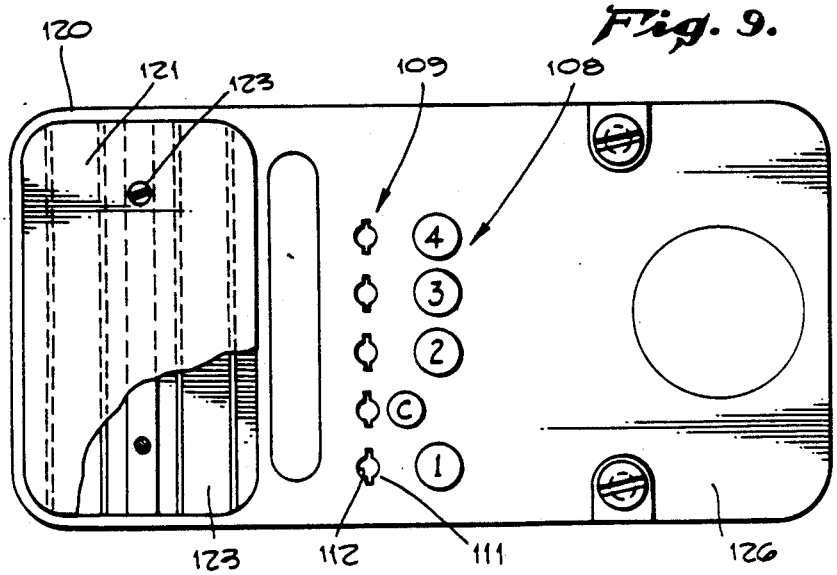
FIG. 9 is, a plain view of the opposite side of the electronic means of FIG. 8.

FIGS. 8, 9 and 10 illustrate the electronic means 100 of lock 20, wherein a combination can be entered into by contact with the electronic means by push pin 75 contacting upon pressure sensitive switches 102 as shown in FIG. 8. Numerous predetermined contacting of switches 102 generates an electronic signal, which as noted above, will cause withdrawal of a solenoid armature 82 and head tab 84 from control plate 60. This will enable the opening of lock 20. The electronic means 100 for generation of that signal will be discussed in more detail hereinafter.

Now more particularly to FIG. 2, the bolt operating release mechanism 40 enables the electronic and manual operation of lock 20 through its multifunction capability. Components of the bolt operating release mechanism 40, include: a control plate 60, a bolt operating lever 42 and a fence-spindle assembly 50. The components assemble together and can rotate as one unit during the manual operation of the lock as shown in FIG. 7.

Bolt operating lever 42 has a pivotally connected end 44 which mounts to lock bolt 27, as shown in FIG. 1, by means of mounting bolt 49. At the opposite end of the pivotally attached end 44 is a free end with a cam following nose 46. At the pivotally attached end is a safety finger 43 which prevents the over-rotation of the bolt operating lever during operation and opening of lock 20. As shown in FIG. 5, once the cam is rotated and the nose portion 46 contacts cam disc 70's raised section 77, the bolt operating lever 42 rotates in a clockwise manner and safety knob 43 prevents overrotation and positions the bolt operating lever 42 in the correct position for insertion or withdrawal of the solenoid armature 82 and head tab 84. Additionally, at the pivotally attached end of bolt operating lever 42 is a mounting release knob 45 which prevent over-torquing of bolt 49 as it attaches bolt operating lever 42 to bolt 27 by insertion of bolt 49 through aperture 47. Cutout 48 provides for bolt operating release mechanism 40 rotation about the pivotally connected end 44 of bolt operating lever 42 within housing 24. As shown in FIG. 5, a nose portion 46 contacts raised cam portion 77, whereupon cutout 48 along bolt operating lever 42 allows rotation of the whole mechanism 40, as well as the bolt operating lever alone, without contacting the bushing 64 of housing 24.

The bolt operating release mechanism 40 is joined as a unit by means of a journalled spindle 54 of a fence-spindle assembly 50, with a hex head end 55. Journalled spindle 54 connects the fence-spindle assembly 50 to the bolt operating lever 42 through orifice 47. Hex head section 55 connects to control plate 60 by means of hex orifice 62.

Cam disc 70 is rotated about by shaft 30 and connected to it by opening 76 which slides on shaft 30 and where pins 79 (as shown in FIG. 1) are placed in cutouts 78 for attachment of the cam disc 70 to shaft 30.

The solenoid 80 as shown in FIG. 1, mounts to mounting bracket 41 on bolt control lever 42. The mounting nut 87 of solenoid 80, mounts the solenoid 80 to mounting bracket 41 for proper positioning along bolt operating control lever 42 to ensure the proper insertion and withdrawal of solenoid armature 82 and head tab 84.

Upon rotation of dial 34 as shown in FIG. 3, to a position as marked by dial markings 33 on dial 34, which also can be indicated on dial disc 36, the shaft 30 can be axially displaced into lock 20 by applying pressure to the dial at faceplate 35 or by gripping around the dial 34 and pushing the dial 34 inward. The dial 34 can be rotated to a position where its proper positioning will enable the push pin 75 connected to cam disc 70, to contact one of a plurality of circularly arranged pressure sensitive switches 102 on circuit component mounting board 103 within the housing 24 of lock 20.

The pressure sensitive switches 102, as shown in FIG. 8, are located within housing 24 in a position parallel to cam disc 70 in which push pin 75 concentrically rotates about said circular pattern of pressure sensitive switches 102.

Upon rotation of dial 34 and proper orientation and axial displacement, push pin 75 contacts one of a plurality of circularly arranged pressure sensitive switches 102, which generates an electrical signal for each contact. Upon multiple pre-determined positional contacting of the plurality circularly arranged pressure sensitive switches 102 by push pin 75, an electronic signal will be generated to a holding means as indicated here but not limited to a solenoid 80. The signal will cause the solenoid armature 82 and its head tab 84 to withdraw from control plate 60, allowing the meshing of nose portion 46 and cam disc 70.

In order that there will be no misangular displacements of shaft 30, upon the circumferences of shaft 30 will be a series of gear teeth (not shown) which will have with it a matching, but perpendicular set of teeth mounted surroundably about shaft 30 and its associated teeth, within housing 24. (Not shown.) Upon the proper orientation of dial 34 to the correct marking via dial markings 33 or markings on dial disc ring 36, displacement of shaft 30 will put push pin 75 into contact with pressure sensitive switches 102. This will be done at one of those predetermined orientations which will match up with the appropriate pressure sensitive switches. The teeth would match up so that the teeth perpendicular to those on the shaft would match up at a specific orientation and upon displacement of shaft 30, push pin 75 would contact the appropriate pressure-sensitive switch 102.

The electronic operation of lock 20, through the means noted above will cause the withdrawal a solenoid armature 82 and its associated head tab 84 from a control plate 60 as shown in FIG. 4, which will cause the opening of lock 20.

The control plate 60 rotates with the pivotally attached bolt operating lever 42 in a clockwise fashion during rotation of dial 34. In addition, control plate 60 can also rotate in a clockwise fashion around journalled spindle 54 when the solenoid 80 is activated. Control plate 60 will rotate counter-clockwise about journalled spindle 54 when lock 20 is closed after opening.

Torque spring 59, as shown in FIG. 5, enables the control plate 60 to maintain its position relative to the bolt operating lever 42 and rotate about hex head portion 55. The electronic signal generated as noted above, will allow the solenoid armature 82 to withdraw from lock slot platform 65 and its associated lock slot 66 as shown in FIGS. 4 and 5. Lock slot platform 65 has in it a large lock slot opening 66 and a smaller slot 68, adjacent to lock slot 66. Insertion of head tab 84 and armature 82 into the lock slot platform 65 when control plate 60 is the position as shown in FIG. 5, will occur because there is no interfering section to prevent its insertion or withdrawal. Upon rotation of shaft 30 and when cam nose 46 is not in contact with raised cam section 77, the armature head tab 84 is in intimate contact with adjacent slot 68. The positioning within smaller slot 68 prevents the withdrawal of solenoid armature 82 and its associated head tab 84 upon the generation of a signal to the solenoid 80. Also note that this feature, holding head tab 84 in slot 68 will also prevent unnecessary movement due to vibrations of lock 20.

The generation of the electronic signal to withdraw said solenoid armature 82 and its associated head tab 84 from control plate 60 will enable the nose portion 46 to engage the cam cutout 72 allowing upon subsequent rotation of dial 34, the withdrawal of lock bolt 27 from its recess 28 within a wall 29 having the secured area opened.

Fence-spindle assembly 50 has a journalled spindle 54 and its hex head 55 on a fence plate 52 at an opposite end from spindle 54, in the opposite direction to a fence member 56. (See FIG. 2.) Upon rotational operation of dial 34 and shaft 30, initializing the manual combination override mechanism of lock 20, fence member 56 engages the gate area 94 of a plurality of tumblers 90, as shown in FIG. 7.

The manual combination override feature assures the capability of opening lock 20 in the event the electronic combination is forgotten, or there is an electronic misfunction or a power loss, and/or damage to the electronic means 100 of lock 20. The manual combination override feature has the bolt control release mechanism 40, rotate in a clockwise fashion as one entire unit, as opposed to the independent rotation of face plate 60 in the electronic mode of operation of lock 20 as shown in FIG. 6.

Solenoid 80 is one method that can hold control plate 60 with for unitary movement bolt operating lever 42. The operation in the electronic mode will releasably allow rotation of said plate 60 in order to mesh nose portion 46 with cam disc cutout 72. A solenoid 80 is not the only means in which this could be accomplished. Another method or manner in which this can be accomplished is with a series of magnetic switches, a series of withdrawable electronically controlled pins and any number ways as well one skilled in the art could contemplate for releasably holding control plate 60.

FIG. 8 shows the component mounting board 103. Component mounting board 103 has on it a series of circular pressure-sensitive switches 102 and a circuit pattern containing circuit logic and design 106 for retention of an electronic combination which will be contacted by push pin 75, as described above, for generation of an electronic signal which will open lock 20.

As shown in FIG. 3, the electronic means is inside the wall or door 22 with its own covering 126. The covering or housing 126 covers the backside or reverse side of circuit component mounting board 103.

In FIG. 8, we see area 120 which contains a power source 122 for the operation of the electronic means. The power source 122 is contained within the housing 24 and alongside the electronic component mounting board 103 as shown in FIG. 3. Power source 122 has in its cavity two holding areas 124 and 125 for the positioning and retention of two commercially available dry or wet cell batteries or power source storage units. The batteries are placed within the packaged area 120 by removal of bolt 123 and cover 121.

The batteries enable the operation of lock 20 independent of a power source, such as AC or DC current. Alternatively, the batteries or storage cells, which contain electrical current can operate the electronic means of lock 20, as an emergency power source back-up. In case of a power failure or an attempted tampering with said lock mechanism where the main power source is disconnected, power source 122 will generate sufficient power to operate lock 20. The batteries or power source would be stored in a hermetic environment encased in such material, which for whatever reason the chemical components of the batteries or storage cells would leak, would prevent such leakage into other areas of the lock 20 housing 24.

On the reverse side of component board 103 as shown in FIG. 9, are a series of pressure-sensitive switches 108 and key seats 109 adjacent thereto. The plurality of key seats 109 have key openings as indicated by 111, which has a key seat 112 in which a key 110 fits.

The pre-determined electronic combination noted above, in which pressure-sensitive switches 102 are contacted by push pin 75 through axial displacement of shaft 30 upon inward pressure of dial 34 are set by means of the use of key 110, key seats 109 and pressure-sensitive switches 108 on the reverse side of circuit mounting board 103. Key 110 is inserted into one of a plurality of key seats indicated at 109 and in order for entry of the electronic combination. The key 110 is entered and turned to the right or left with one of the pressure-sensitive switches 100 then contacted. There would be an entry combination code in which the pressure-sensitive switches 108 and key 110 would be inserted and turned and pressed in a pre-determined order, so that the combination of the electronic pressure-sensitive switches 102 in which are to be contacted by push pin 75 can be set. Subsequent to the entry combination code by means of key 110, seats 109 and pressure-sensitive switches 108, the operator will insert the key, turn it to the opposite direction to that used to gain entry. The pattern or combination can be set by the turning of the key 110 and the pressing of the associated switches 108 a number of times to indicate the correct number. For example, if the first number that was to be set in the electronic combination was to be five, the key 110 would be placed in the key seat opposite to pressure-sensitive switch numbered 4 and key 110 would be turned and 4 would be contacted, and then key 110 would be withdrawn, key 110 would be then placed in the key seat associated with pressure-sensitive switch numbered 1, turned and would be contacted. Finally, key 110 would be entered into the key seat associated with pressure-sensitive switch marked with Alpha C on it. The key would be turned and the Alpha C switch contacted and the number of the electronic combination would be entered. Obviously, the uses of switches 4 and 1 are only as for example, as switches 3 and 2, could be utilized to generate the number 5. The switches 108 and associated keyseats 109 numbered one through four and indicated control pressure-switch with Alpha C are only for example. The embodiment of an alternative combination input mechanism could have nine switches and keyways or fewer or as indicated.

On dial 34 there could be divisions associated with zero, one, two, three, four, five, six, seven, eight, nine or to whatever circular pattern of pressure-sensitive switches one would contemplate for the electronic combination. These designations and/or orientations of pressure-sensitive switches could also be marked on dial ring 36 in order to make its use easier for the operator to dial in the correct positional orientations.

Having thus described a preferred exemplary embodiment of an electronic lock with a manual combination override in accordance with the present invention and alternatives noted thereof, which should be appreciated by those skilled in the art that the foregoing objects are attained by the present invention. Further, it should be appreciated that the exemplary embodiment is intended to be exemplary only in that various modifications, alterations and adaptions thereof may be made within the scope of the present invention which is defined by the following claims.

I claim:

1. In an electronic lock with a manual combination override, including a dial operated plurality of tumbler wheels having gates to receive a fence member of a bolt operating lever when the manual combination is dialed, and an electronic means for generating a lock opening signal when a second combination is entered into said electronic means, the improvement comprising the provision of:

said bolt operating lever being provided with one end pivotally connected to said bolt and an opposite free end with a nose portion to be engaged by a dial-operated cam for a release movement of the bolt;

a separate fence for engaging said gates and means for movably mounting it relative to said lever;

and means for holding said fence immovable relative to said lever until said electronic means generates a lock opening signal;

whereby said fence and bolt operating lever move as a unit in the manual combination opening of the lock and said bolt operating lever is released from said fence for opening said lock when the electronic combination means is employed.

2. In an electronic lock with a manual combination override, including a dial operated plurality of tumbler wheels having gates to receive a fence member of a bolt operating lever when the manual combination is dialed, and an electronic means for generating a lock opening signal when a second combination is entered into said electronic means, the improvement comprising the provision of:

said bold operating lever being provided with one end pivotally connected to said bolt and an opposite free end with a nose portion to be engaged by a dial-operated cam for a release movement of the bolt;

a separate fence for engaging said gates and means for movably mounting it relative to said lever;

and means for holding said fence immovable relative to said lever until said electronic means generates a lock opening signal wherein the means for holding said fence immovable relative to said bolt operating lever comprises:

a control plate connected to said fence for common pivotal movement relative to said lever;

an electrically operated solenoid having an armature member normally biased outwardly of a solenoid body and being electrically operated by said lock opening signal to cause movement of said armature inwardly of said body; and solenoid mounting means for mounting said solenoid to normally place said armature in a position to block pivotal movement of said control plate relative to said lever until said armature is moved inwardly relative to said solenoid body;

whereby said fence and bolt operating lever move as a unit in the manual combination opening of the lock and said bolt operating lever is released from said fence for opening said lock when the electronic combination means is employed.

3. The improvement in electronic lock of claim 2, wherein:

said control plate is provided with a lock-slot; and said solenoid armature is provided with a head tab on an outer end thereof which is receivable in said lock-slot.

4. The improvement in electronic lock of claim 3, wherein:

said lock-slot includes a flange protruding at least partially into said slot; and said head tab when received in said lock slot, lies at least partially under said flange.

5. In an electronic lock with a manual combination override, including a dial operated plurality of tumbler wheels having gates to receive a fence member of a bolt operating lever when the manual combination is dialed, and an electronic means for generating a lock opening signal when a second combination is entered into said electronic means, the improvement comprising the provision of:

said bolt operating lever being provided with one end pivotally connected to said bolt and an opposite free end with a nose portion to be engaged by a dial-operated cam for a release movement of the bolt;

a separate fence for engaging said gates and means for movably mounting it relative to said lever wherein said fence is provided as part of a fence-spindle assembly of a fence and spindle for pivotally mounting the fence relative to the bolt operating lever;

and means for holding said fence immovable relative to said lever until said electronic means generates a lock opening signal wherein said means for holding said fence immovable relating to said lever comprises:

a control plate having a hex head orifice for joining with said spindle of said fence-spindle assembly;

a lock-slot on said control plate; and a solenoid attached to said bolt operating lever by a mounting means for securing said solenoid on said lever, said solenoid having a solenoid armature with a head tab;

whereby the control plate is normally held in an immovable position through the retention of said solenoid armature head tab in said lockslot and said fence and bolt operating lever move as a unit in the manual combination opening of the lock and upon generation of said electronic signal, said armature releases said head tab from said lock-slot enabling independent rotation of said lever, relative to said plate and fence, and said bolt operating lever is released from said fence for opening said lock when the electronic combination means is employed.

6. The improvement of the electronic lock of claim 5, wherein the fence-spindle assembly comprises:

a journalled spindle;

a fence arm;

a fence plate;

whereby the journalled spindle engages and rotationally joins said fence-spindle assembly with said bolt operating lever and control plate for unitary rotational movement upon the manipulation of said tumblers which allows said fence to engage with said bolt lever and said plate which opens the lock and relative rotation between the components upon input of the electronic combination means which opens the lock.

7. In an electronic lock with a manual combination override, including a dial operated plurality of tumbler wheels having gates to receive a fence member of a bolt operating lever when the manual combination is dialed, and an electronic means for generating a lock opening signal when a second combination is entered into said electronic means, where the electronic signal generating means comprises:

a series of thin film pressure sensitive switches arranged in circular pattern on a circuit component mounting board;

a circuit component mounting board which has a circuit means to generate an electrical signal which activates and engageably withdraws a connecting means which insertably holds a control plate in a unitary position with a bolt operating lever and a fence;

an electrical combination contacting means for contacting said pressure sensitive switches in a combination pattern to generate said signal;

whereby upon the rotational and axial movement of said dial, the pressure switches are contacted in a prescribed combination pattern which will engageably join said nose portion of a bolt lever with said cam disc by the withdrawal of said control gate connecting means for insertably holding said control plate, subsequent to this engagement the further rotation of said dial will open said lock, the improvement comprising the provision of:

said bolt operating lever being provided with one end pivotally connected to said bolt and an opposite free end with a nose portion to be engaged by a dial-operated cam for a release movement of the bolt;

a separate fence for engaging said gates and means for movably mounting it relative to said lever;

means for holding said fence immovable relative to said lever until said electronic means generates a lock opening signal; and where the input of said electronic combination pattern comprises:

a key;

a series of key seats;

a series of pressure sensitive switches mounted on the reverse side of a circuit component mounting board whereupon there are a series of pressure sensitive switches arranged in a circular pattern which upon contact in a specific pattern will generate an electronic signal causing the lock to open;

a circuit logic means for inputting and retaining a combination pattern for said circular series of pressure switches;

whereby the key seats are arranged with a reciprocal pressure sensitive switch upon the entry of the key into the key seat and the turning of the key in one direction and subsequent contacting of said switches in a predetermined pattern allows the changing of said combination pattern by turning the key in the opposite direction and then pressing said pressure sensitive switches in an order which will then encode the combination for the circular pattern series of pressure sensitive switches on the circuit component mounting board;

whereby said fence and bolt operating lever move as a unit in the manual combination opening of the lock and said bolt operating lever is released from said fence for opening said lock when the electronic combination means is employed.

8. In an electronic lock with a manual combination override, including a dial operated plurality of tumbler wheels having gates to receive a fence member of a bolt operating lever when the manual combination is dialed, and an electronic means for generating a lock opening signal when a second combination is entered into said electronic means, the improvement comprising the provision of:

said bolt operating lever being provided with one end pivotally connected to said bolt and an opposite free end with a nose portion to be engaged by a dial-operated cam for a release movement of the bolt;

a separate fence for engaging said gates and means for movably mounting it relative to said lever;

means for holding said fence immovable relative to said lever until said electronic means generates a lock opening signal whereby said fence and bolt operating lever move as a unit in the manual combination opening of the lock and said bolt operating lever is released from said fence for opening said lock when the electronic combination means is employed; and an electronic overload thermal activated safety means locking system for preventing the release of the lock bolt due to the tampering or by an electrical surge by means of a heat activatable safety fuse, a bias ring and a means for maintaining the bolt in a locked position.

9. The improvement of the electronic lock of claim 8 wherein the activatable safety means comprises:

a solid fuse of temperature sensitive material;

a biased spring with a stiff leg portion;

a lock bolt with a slot of sufficient size for said stiff leg portion;

whereby an electrical surge or an attempted tampering with of the lock a drill will generate heat causing said fuse to melt, which had releasably held said spring stiff leg in a position opposite said slot, thereby allowing its entry into said slot preventing any movement of said bolt.

10. In an electronic lock with a manual combination override, including a dial operated plurality of tumbler wheels having gates to receive a fence member of a bolt operating lever when the manual combination is dialed, and an electronic means is generating a lock opening signal when a second combination is entered into said electronic means, the improvement comprising the provision of:

said bolt operating lever being provided with one end pivotally connected to said bolt and an opposite free end with a nose portion to be engaged by a dial-operated cam for a release movement of the bolt;

a separate fence for engaging said gates and means for movably mounting it relative to said lever, means for holding said fence immovable relative to said lever until said electronic means generates a lock opening signal; and a power source contained within the housing of said electronic lock;

whereby said fence and bolt operating lever move as a unit in the manual combination opening of the lock and said bolt operating lever is released from said fence for opening said lock when the electronic combination means is employed.

11. The improvement of the electronic lock of claim 10, wherein the power source comprises:

a power source which is a wet or dry cell electrical storage means for storing sufficient power to continue the operation of said lock for a determined period of time.

12. The improvement of the electronic lock of claim 11 wherein the power source further comprises:

a means for continually charging said power source over time during full-up powering of the electronic lock by standard electrical means of a main power source.

13. The improvement of the electronic lock of claim 10, wherein the power source comprises:

a lid;

a cavity for power source storage cells;

a securing means for securing lid to packaged body;

a securing means for sealing said package in a hermetic environment;

packaging materials to keep power source storage cells self-contained within said packaged body during operation of the electronic lock and to prevent any leakage from said cells into other areas of the lock.

14. In a lock with a manual combination capability to override the misfunction of an electronic lock provision, including a dial operated plurality of tumbler wheels having gates to receive a member of a bolt operating assembly when the manual combination is dialed and upon operation of the electronic means which generates a lock opening signal when a second combination is entered into said electronic means for generating a lock opening signal, the improvement comprising:

the provision of said bolt operating lever being provided with one end pivotally connected to said bolt and an opposite free end with a nose portion to be engaged by a dial operated cam for a releasing movement of the bolt;

a separate fence and spindle of a fence-spindle assembly for movably mounting on said lever;

a control plate movably engaged to said fence-spindle assembly and mounted to said bolt operating lever;

a self-contained power source for maintaining the electronic capabilities of the lock during failure of the main power source and for use independent of said main power source;

whereby said fence, bolt operating lever, and control plate move as a unit in the manual combination mode and said bolt operating lever released from said fence for opening said lock when said electronic combination mode causes the electronic means for generating a lock opening signal to generate said signal causing the lock to open.

15. The improvement of the electronic lock of claim 14 wherein the connecting means comprises:

a solenoid;

a solenoid armature;

a head tab;

a mounting means;

whereupon the solenoid is connected to the bolt operating lever by a mounting means positioning said solenoid upon said lever in order that said solenoid armature and head tab can withdrawingly engage the plate control;

the mounting position enables said solenoid to retractably extend said armature head and tab to withdrawingly engage plate control lock within plate holding means for holding said plate;

whereby the operation of the electronic combination mode means for generating an electronic signal causing the release of said control plate which will cause said lock to open.

16. The improvement of the electronic lock of claim 14 wherein the holding means comprises:

a platform;

a slotted section;

a plurality of supports;

the platform sits on said control plate arcuate end supported by sections on all sides except for that facing the solenoid, said face facing the solenoid has an opening sufficient for entry of said armature and head tab, upon the desired rotation of said control plate in a clockwise manner whereupon a slot adjacent to said armature matingly surrounds said armature;

whereby said head tab's withdrawal is prevented by said lock slot's adjacent slot's positioning around said armature, the size of said slot being insufficient for said head tab's withdrawal, whereupon the proper manipulation of said dial operated cam will rotate said control plate in the position for removal of said tab head and armature upon generation of the electronic signal by the electronic combination mode means which causes the lock to open.

17. The improvement of the electronic lock of claim 14 wherein the dial operated cam comprises:

a disc upon rotation that translates parabolic motion to a nose portion of a bolt operating lever;

a slot within the body of said disc wherein said nose portion of said bolt operating lever engages and meshes with said disc;

a raised surface on said cam disc's circumference that translates motion which rotates said fence plate slot to a position for retraction or insertion of a solenoid tab head and armature upon input of an electronic signal by an electronic combination mode means;

a shaft which is biased in the direction opposite to said cam; doweled to said disc through its center at one end and connected to a dial at the opposite end;

a dial which is joined with said shaft on the exterior of a housing containing said lock at a position opposite to said cam disc;

whereby manipulation of said dial rotationally moves said shaft and the disc cam in a manner so that the fence lever will engage the gates of a plurality of tumblers, enabling the nose of the bolt operating lever to engage the disc which will throw the bolt; and upon the rotational and axial movement of said dial and said shaft, an electrical contact means will generate an electronic signal which will release a holding means which maintains a control plate in a unitary position with the bolt operating lever and a fence which enables the nose of said bolt operating lever to engage said disc and upon rotation of said dial, throw said bolt and opens the lock.

18. The improvement of the electronic lock of claim 14, where the electrical contacting combination means comprises:

a push pin mounted in a transverse position to the surface of the cam disc;

said push pin is positionally attached on the cam disc surface at a point opposite to the circular arranged pattern of pressure sensitive switches that upon rotation of said cam disc, the push pin would rotate concentrically above said switches;

whereby, the axial movement of said shaft by a force exerted in a direction of the switches upon the dial at a dial position that allows movement axially of said shaft and that overcomes said biasing of said shaft, the inward force on said dial causes the push pin to contact one of the said switches sufficiently to cause electrical contact;

upon subsequent dial manipulations and axial displacements by said push pin, an electronic signal is generated which releases the holding means upon said control plate which subsequently causes the lock to open.

19. The improvement of the electronic lock of claim 14 where the input of said electronic combination pattern comprises:

a key;

a series of key seats;

a series of pressure sensitive switches mounted on the reverse mode of a circuit component mounting board whereupon there are a series of pressure sensitive switches arranged in a circular pattern which upon contact in a predetermined specific order will generate an electronic signal causing the lock to open;

a circuit logic means for inputting and retaining a combination pattern for said circular series of pressure switches;

whereby the key seats are arranged with a reciprocal pressure sensitive switch, upon the entry of the key into the key seat and the turning of the key in one direction and subsequent contacting of said switches in a predetermined pattern allows the changing of said combination pattern by turning the key in the opposite direction and then pressing said pressure sensitive switches in an order which will then encode the combination for the circular pattern series of pressure sensitive switches on the circuit component of the mounting board.

20. A kit for retrofitting a dial operated combination lock with an electronic lock with a manual combination override, wherein the kit comprises:

a means for mounting said lock shaft for both rotational and axial displacement including a biasing means for biasing said shaft in an axial direction toward said dial;

contacting means for contacting the electronic means for generating an opening signal for installation on said shaft opposite to said dial for exerting a force to enable the contacting means to make contact in each of a plurality of distinct, unique locations within said lock when said shaft is displaced axially into a housing which the manual combination lock was housed and will house the electronic lock kit;

at each of a plurality of distinct rotational orientations of said shaft an orientation means to ensure proper angular displacement of said contacting means;

a release means rotationally opening said lock axially attached to said lock bolt at a first end and a nose portion at a second end, said releasing means engaging said contacting means on said shaft;

a control plate which engagingly mates and joins with said release means;

a fence and transverse spindle of a fence-spindle assembly for movably mounting on said release means;

wherein in said release means, said fence-spindle assembly, and said control plate can act relative to each other or as a unit;

component mounting board means for installation within said lock housing behind and parallel to said contacting means, including pressure sensitive switching means for generating electronic signals arrayed at such distinct locations for making one of a plurality of distinct, unique electrical connections when contacted by said contacting means when said shaft is axially displaced into said lock housing at said distinct angular orientation;

an electronic logic means for detecting that a given subset of connections to said switches has been made in a predetermined, sequential order corresponding to an opening lock electronic combination;

a signal generating means for generating an electrical signal when an electronic combination is entered by means of the contacting means through axial contacting;

a power source means for bringing power to said circuits to be contained within said housing;

a set of tumbler and associated gates which will be mounted around the circumference of said shaft in a concentric manner, said tumblers will cooperatively rotate with said contacting means on said shaft enabling the concurrent meshing of said contacting means and said releasing means upon input of a manual combination;

said release means, fence-spindle assembly and control plate move as a unit upon the input of said electronic combination by axially displacing said shaft in a predetermined orientation prescribed order which generates an electrical signal which opens said lock, and the rotation of said shaft by use of said dial which will orient said tumblers in a pattern to enable the entry of a fence member into the tumbler gates, which will release said release means resulting in an opening of the lock in a manual mode.

* * * * *